US007549426B2

(12) United States Patent
Koga et al.

(10) Patent No.: US 7,549,426 B2
(45) Date of Patent: Jun. 23, 2009

(54) METHOD OF REDUCING NITRITE AND/OR NITROSAMINE IN TOBACCO LEAVES USING MICROORGANISM HAVING DENITRIFYING ABILITY

(75) Inventors: Kazuharu Koga, Oyama (JP); Satoshi Katsuya, Oyama (JP)

(73) Assignee: Japan Tobacco Inc., Tokyo (JP)

( * ) Notice: Subject to any disclaimer, the term of this patent is extended or adjusted under 35 U.S.C. 154(b) by 487 days.

(21) Appl. No.: 11/094,524

(22) Filed: Mar. 31, 2005

(65) Prior Publication Data

US 2006/0225751 A1 Oct. 12, 2006

(51) Int. Cl.
*A24B 15/00* (2006.01)

(52) U.S. Cl. ..... 131/290; 800/317.3

(58) Field of Classification Search ..... 131/290; 800/317.3

See application file for complete search history.

(56) References Cited

U.S. PATENT DOCUMENTS 4,566,469 A * 1/1986 Semp et al. ..... 131/308
2001/0000386 A1 4/2001 Peele
2005/0115576 A1 6/2005 Koga et al.
2006/0225750 A1 10/2006 Koga et al.

FOREIGN PATENT DOCUMENTS

| | | | |
|---|---|---|---|
| EP | 1 504 679 | A1 | 2/2005 |
| JP | 9-40515 | A | 2/1997 |
| JP | 10-7483 | A | 1/1998 |
| WO | WO-83/01180 | A1 | 4/1983 |
| WO | WO-98/05226 | A1 | 2/1998 |
| WO | WO-01/35770 | A1 | 5/2001 |
| WO | WO-02/13636 | A1 | 2/2002 |
| WO | WO-03094639 | A1 | 11/2003 |

OTHER PUBLICATIONS

Programme and Abstracts of 2006 Coresta Congress, AP16 (pp. 73-74).

* cited by examiner

*Primary Examiner*—Carlos Lopez
(74) *Attorney, Agent, or Firm*—Birch, Stewart, Kolasch & Birch, LLP

(57) ABSTRACT

A method of reducing the content of nitrite and/or nitrosamine in tobacco leaves, having treating the tobacco leaves with a microorganism belonging to *Agrobacterium* genus and having the denitrifying ability.

2 Claims, 1 Drawing Sheet

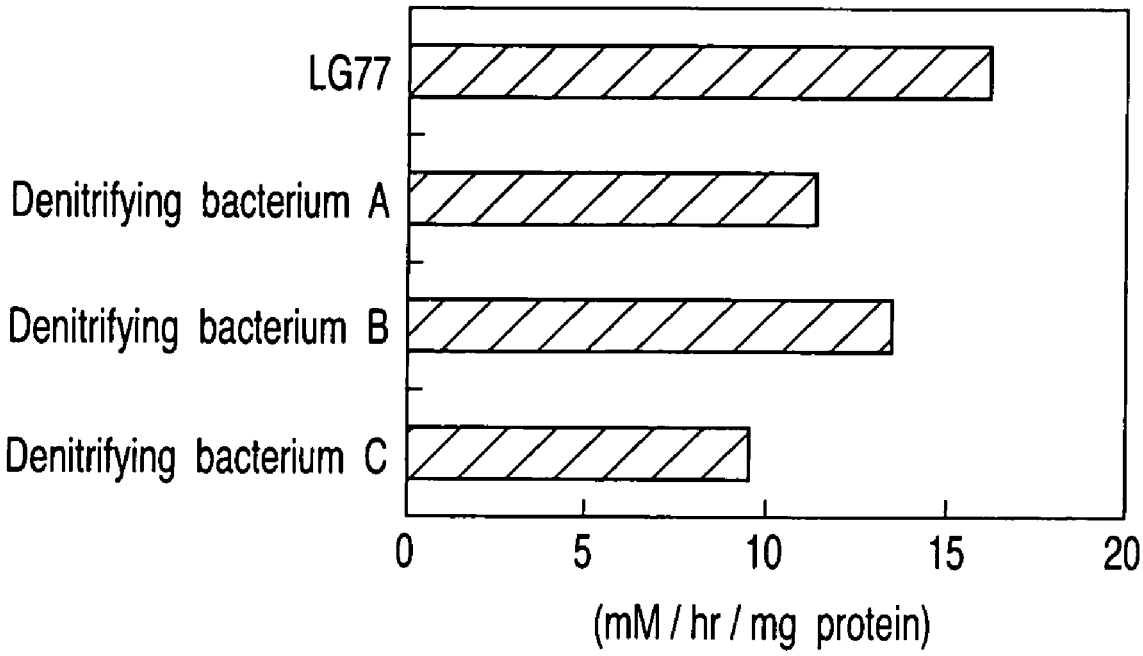
FIGURE

METHOD OF REDUCING NITRITE AND/OR NITROSAMINE IN TOBACCO LEAVES USING MICROORGANISM HAVING DENITRIFYING ABILITY

BACKGROUND OF THE INVENTION

1. Field of the Invention

The present invention relates to a method of reducing the content of tobacco specific nitrosamines (hereinafter referred to as "TSNA") in tobacco leaves, which are formed by reaction between nitrite and alkaloids during curing and/or storage processes of the tobacco leaves. More particularly, the invention relates to a method of reducing TSNA content in the tobacco leaves by decreasing the nitrite accumulation through denitrification of nitrate or nitrite and thereby inhibiting formation of TSNA in the tobacco leaves.

2. Description of the Related Art

TSNA contained specifically in cured tobacco leaves are not present in tobacco leaves immediately after harvest; however, during the curing process and storage process thereafter, TSNA are formed by reaction of nitrite and alkaloids contained in the tobacco leaves. The main components of TSNA formed in such a manner are N-nitrosonornicotine (hereinafter, referred to as "NNN"), 4-(N-nitrosomethylamino)-1-(3-pyridyl)-1-butanone (hereinafter, referred to as "NNK"), N-nitrosoanatabine (hereinafter, referred to as "NAT"), N-nitrosoanabasine (hereinafter, referred to as "NAB"), and the like.

The varieties of tobacco cultivated in Japan are broadly classified into three groups; flue-cured tobacco, Burley tobacco, and Japanese domestic tobacco.

The harvested tobacco leaves are green, but chlorophyll in the plant cell is degraded and carotenoide pigment appears during curing process. The carotenoide pigment is a yellow color pigment and thus the color of the tobacco leaves turns to be yellow.

With respect to the flue-cured tobacco, after the tobacco leaves turn to be yellow, the speed of dehydration is quickened by raising the curing temperature, and finally the color of the cured leaves is fixed to be yellow.

On the other hand, with respect to Japanese domestic and Burley tobaccos, the curing process still continues after yellowing stage, and during the continuous curing stage, the carotenoide pigment is degraded and a brown pigment is produced to turn tobacco leaves to be brown. After that, the lamina and stem are completely dried and the curing process is finished. As described, the Burley and Japanese domestic tobacco leaves turn to be cured leaves through yellowing, browning, and stem drying stages.

The flue-cured tobacco and the Burley and Japanese domestic tobaccos differ in the curing methods. In the case of curing the flue-cured tobacco, harvested tobacco leaves are hung in a curing barn (a bulk curing barn) equipped with a heater, and cured while the temperature and humidity being controlled by using wind and fire powers, so that the tobacco leaves are cured in 5 to 7 days through the yellowing stage, color-fixing stage, and stem drying stage. On the other hand, in the case of curing the Burley and Japanese domestic tobaccos, harvested tobacco leaves are hung in a pipe house or a wooden curing house and cured while the temperature and humidity being controlled mainly in natural conditions, so that the tobacco leaves are cured in 25 to 35 days through the yellowing stage, browning stage, and stem drying stage.

Such curing of the tobacco leaves is carried out aiming not only to dry the tobacco leaves but also to convert the components in the tobacco leaves and provide colors, flavor and taste that are specific to the tobacco varieties. Thereafter, for maturing further flavor and taste, the tobacco leaves that have been finished the curing process are stored. However, during such curing and storage processes, the formation of TSNA is caused by a reaction of nitrite with alkaloids contained in the tobacco leaves. In the case of flue-cured tobacco, TSNA are formed mainly during curing by heating and in the case of Burley tobacco, TSNA are formed from the browning stage to stem drying stage in the curing processing steps.

It has been known that laminas of tobacco leaves immediately after harvest contain amino acids, proteins, and alkaloids as well as nitrate and nitrite. Generally, plants produce amino acids from nitrate via nitrite in vivo and utilize the amino acids for formation of the plant. On the other hand, since nitrite in a high concentration causes adverse effects on life of the plant, plants synthesize only in the minimum amounts required for utilization for the plant formation. Accordingly, the content of the nitrite-nitrogen in the tobacco leaves is 1 ppm or lower immediately after harvest.

However, during the curing process of the tobacco leaves, because of the function of nitrate reducing enzymes produced by microorganisms existing in the tobacco leaf surface, the nitrate in the tobacco leaves is reduced to nitrite. The produced nitrite is reacted with alkaloids in the tobacco leaves, so that TSNA are formed and accumulated in the leaves.

Conventionally, various techniques for reducing the TSNA content in the tobacco leaves have been proposed and for example, there have been proposed as follows.

In terms of cultivation of tobacco, there is a method of decreasing the amount of a nitrogen fertilizer to be used. Decrease of the amount of the nitrogen fertilizer reduces the alkaloid content in the leaves, which are origin substances of TSNA formation. It has been proved that the TSNA content in the leaves is decreased by the method.

In terms of plant breeding, new varieties having less alkaloid content in the leaves have been developed. In such development, seeds are taken out of plants having less alkaloid content and cultivated, so that varieties having a low TSNA content can be obtained.

With respect to flue-cured tobacco, there is proposed a method of reducing TSNA content by adopting an indirect-heating type of curing barn in place of a direct-heating type of curing barn. In this method, use of the indirect-heating type of curing barn reduces $NO_x$, a precursor of TSNA, derived from fuel, so that the TSNA production is suppressed during the curing process (U.S. Patent Application Publication No. US 2001/386).

Further, there is proposed a method of rapidly dehydrating and completing the curing process by treating tobacco leaves having a low TSNA content in the yellowing stage of the initial curing process with microwave (WO 98/05226). However, the method finishes curing in the middle of the conventional curing process and results in insufficient change in the components contained in the leaves. Thereby, the purpose of the curing is not accomplished, and it is impossible to exhibit characteristic color, flavor and taste. Accordingly, there occurs a problem that the flavor and taste of the tobacco leaves which have been cured more rapidly is deteriorated as compared with those of the tobacco leaves cured by a conventional method.

To inhibit reduction of nitrate in the tobacco leaves to nitrite by the function of the nitrate-reducing enzymes produced by microorganisms existing in the tobacco leaf surface during the curing process of the tobacco leaves, there is proposed a method of removing the relevant microorganisms in the tobacco leaf surface. For example, a method of washing out the microorganisms with bicarbonate of soda (WO 01/35770), a method of killing microorganisms with chlorine dioxide gas (WO 02/13636), and the like have been know.

Also, a denitrification treatment of the tobacco cured leaves by using a microorganism derived from tobacco leaves (WO 83/01180) is disclosed. However, the method makes it possible to decrease the content of nitrate and nitrogen compounds in the tobacco cured leaves but is insufficient to efficiently reduce TSNA content.

The inventors of the present invention have proposed a method of using TSNA-degrading bacteria as the method of reducing TSNA content in the tobacco leaves during the curing and storage processes (WO 03/094639).

BRIEF SUMMARY OF THE INVENTION

The inventors of the present invention have found that in the yellowing stage immediately after harvest, aerobic microorganisms such as microorganism belonging to *Pseudomonas, Agrobacterium*, or *Xanthomonas* genus are the dominant species (that is, species superior in numbers), however in the subsequent browning stage, facultatively anaerobic microorganisms having the nitrate-reducing ability (hereinafter also referred to as anaerobic microorganisms), particularly microorganism belonging to *Enterobacter* or *Pantoea* genus become the dominant species.

The facultatively anaerobic microorganisms have a high nitrate-reducing ability as compared with the aerobic microorganisms. Actually, in the case tobacco leaves are treated with microorganism belonging to *Enterobacter* or *Pantoea* genus that has been isolated from tobacco leaves in the browning stage, nitrite is accumulated in the tobacco leaves.

The nitrite accumulated in the tobacco leaves causes the TSNA formation by a reaction with alkaloids. However, it can be expected that if the formed nitrite is subjected to reduction, the nitrite is released in the form of $N_2O$ or $N_2$ gases and therefore, no nitrite is accumulated in the tobacco leaves and accordingly formation of TSNA will be suppressed.

The reduction of nitrite in tobacco leaves is expected to be achieved by use of microorganism. Mechanisms of nitrate metabolism by microorganism can be classified into assimilation and dissimilation. The assimilation of nitrate involves synthesizing amino acids via nitrite and utilizing the synthesized amino acids for living and growth of the cells. The dissimilation of nitrate involves nitrate respiration and denitrification and is carried out for obtaining energy for microorganism activity. Nitrate respiration involves reducing nitrate to nitrite but carrying out no further reduction. On the other hand, denitrification involves reducing nitrate along with the following reactions: $NO_3^- \rightarrow NO_2^- \rightarrow NO \rightarrow N_2O \rightarrow N_2$ and finally releasing nitrogen in the form of gas to the outside of the microbial cells.

Inventors of the present invention have investigated on the effect of microorganism belonging to *Pseudomonas* genus, which has been known to have the nitrate-reducing ability, on inhibition of TSNA formation. However, the microorganism belonging to *Pseudomonas* genus cannot be dominant on the surface of the tobacco leaves during the curing process and therefore, it is found that the nitrate reduction effect cannot be so significant as expected and accordingly the TSNA content is not decreased sufficiently.

The purpose of the present invention is to reduce the content of TSNA in tobacco leaves by reducing nitrite that is accumulated in the tobacco leaves during curing and storage processes and thereby inhibiting TSNA formation. Further, the purpose of the present invention is to provide a method of reducing the content of TSNA in tobacco leaves without causing adverse effects on the flavor and taste of the tobacco leaves and without changing the presently adopted curing and storage processes.

The inventors of the present invention have searched for a microorganism which has the denitrifying ability and high survival rate in the surface of tobacco leaves and which causes no adverse effects on the flavor and taste of the tobacco, and as a result, the inventors have found that a microorganism belonging to *Agrobacterium* genus satisfies the above-mentioned requirements.

That is, the present invention provides a method of reducing the content of nitrite and/or nitrosamine in tobacco leaves, comprising a step of treating the tobacco leaves with a microorganism belonging to *Agrobacterium* genus and having the denitrifying ability.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The single FIGURE is a graph showing that LG77 strain has the highest nitrate-reducing ability among the isolated denitrifying bacteria.

DETAILED DESCRIPTION OF THE INVENTION

The present invention provides a method of reducing the content of TSNA in tobacco leaves, comprising a step of treating the tobacco leaves with a microorganism belonging to *Agrobacterium* genus and having the denitrifying ability. The present invention also provides a method of reducing the content of nitrite in tobacco leaves, comprising a step of treating the tobacco leaves with microorganism belonging to *Agrobacterium* genus and having the denitrifying ability.

Here, the denitrifying ability means the ability of reducing nitrate and/or nitrite. The microorganism to be used in the method of the present invention includes microorganism belonging to *Agrobacterium* genus and having the denitrifying ability. Preferably, the microorganism is *Agrobacterium radiobacter* having the denitrifying ability.

The microorganism isolated by the present inventors is identified as microorganism belonging to *Agrobacterium radiobacter* from the bacteriological characteristics. The microorganism has been deposited as LG77 (accession number FERM BP-8386) with May 23, 2003 under International Patent Organism Depositary, National Institute of Advanced Industrial Science and Technology (AIST Tsukuba Central 6, 1-1 Higashi 1-chome, Tsukuba-shi, Ibaraki-ken, Japan) The LG77 is, as described above, a strain isolated from the surface of tobacco leaves and cause no adverse effects on the quality of the tobacco leaves.

As described above, the method of the present invention can be carried out by employing the current method of curing tobacco leaves without alteration, except that treatment with the microorganism is carried out. Accordingly, the qualities of the tobacco leaves that are presently made available as a result of various research and development can be maintained in the present invention.

Tobacco leaves to be treated according to the present invention may be any tobacco variety as long as the tobacco leaves allow the flue-curing or air-curing process. Preferable examples are air-cured varieties, specifically Burley tobacco and Japanese domestic tobacco.

The "treatment" with the microorganism in the present invention means addition of microorganism to object tobacco leaves and may be carried out by any of known methods; examples thereof include spraying of suspension of the microorganism, coating of a powder containing the bacterial cells of the microorganism, and immersing the tobacco leaves in a liquid containing the microorganism.

The "reducing" as used herein means decrease of the content and the accumulation of nitrite-nitrogen and/or TSNA formed in the tobacco leaves during curing.

As a culture medium for culturing the microorganism used in the present invention, various types of known culture media for culturing microorganism can be used. Also, with respect to the culturing conditions under which the microorganism is cultured, the temperature may be in a range of 25 to 35° C., preferably in a range of 28 to 32° C., and pH may be in a range of 6.0 to 8.0, preferably approximately 7.0.

In the preparation of the microorganism used in the present invention, the microorganism is cultured for a predetermined period and then collected by centrifugation and suspended in a specific buffer solution to prepare a bacterial suspension. The buffer solution for suspending the bacterial cells may be, for example, sterilized distilled water and phosphate buffer.

In the case the bacterial cells are suspended in the buffer solution, the concentration of the bacterial cells suspended in the buffer solution may be $10^7$ to $10^{12}$, preferably $10^8$ to $10^{10}$ cells per 1 mL of the buffer solution. The bacterial suspension having the above concentration is preferably used in the present invention.

In the present invention, the treatment of tobacco leaves is carried out by using the bacterial suspension prepared as described above. For example, the bacterial suspension that is an inoculation solution for inoculating into tobacco leaves is prepared by adding sterilized distilled water to the bacterial sample containing a necessary amount of the bacterial cells and the obtained solution may be evenly sprayed on the tobacco leaves.

With respect to the amount of the inoculation solution to be sprayed, when the treatment is carried out immediately after harvest or at the initial stage of the curing process, 2 to 10 mL of the inoculation solution may be applied per one piece of tobacco leaf. When the treatment is carried out at an intermediate stage of the curing process or thereafter, 0.5 to 3 mL of the inoculation solution may be applied per one piece of tobacco leaf.

The time when tobacco leaves are treated with the microorganism according to the method of the present invention may be any stage before curing, during curing or after curing, preferably at least before the nitrite is accumulated in the tobacco leaves, namely before the yellowing stage for flue-cured tobacco and before the browning stage for Burley tobacco. For example, tobacco leaves may be treated in a field immediately before harvest and thereafter harvested and cured. The treatment with the microorganism may be carried out once or more times. In the case of carrying out the treatment second time or later during the curing and the storage processes, it is preferable to carry out the treatment at the starting of storage.

EXAMPLES

Example 1

Isolation and Selection of the Denitrifying Bacteria

The microorganism was separated according to the following procedure from tobacco leaves grown in a tobacco field in Oyama-shi, Tochigi prefecture, Japan.

The leaves of Michinoku 1, which is Burley variety, were harvested, and the lamina portions of the harvested tobacco leaves were cut off as samples. The obtained samples were finely cut to 5 mm squares and approximately 10 g of the cut samples was put into a 300 mL Erlenmeyer flask. After that, 200 mL of 10 mM phosphate buffer (pH 7.0) was added thereto and the mixture was homogenized. The obtained suspension was used as a tobacco suspension for isolation of microorganisms.

The obtained tobacco suspension was diluted with the above phosphate buffer to a concentration proper for isolation of microorganisms ($10^2$ to $10^5$ times dilution).

The diluted suspension was applied, by dropping 0.1 mL a time, on a YG agar plate medium (yeast extract 1.0 g; glucose 1.0 g; $K_2HPO_4$ 0.3 g; $KH_2PO_4$ 0.2 g; $MgSO_4 \cdot 7H_2O$ 0.2 g; agar 15 g; and distilled water 1,000 mL, pH 6.8), and then cultured at 30° C. for 7 days.

The grown colonies were separated into a single colony by using a fresh YG agar plate medium. The isolated microorganisms were stored at −80° C. till used for experiments.

The microorganism having the denitrifying ability was selected by the following procedure from the isolated microorganisms.

To culture the test microorganism, the YG agar plate medium was used. The grown microorganism was suspended in sterilized distilled water in a concentration of about $10^7$ cfu/mL to obtain a microbial suspension for inoculation.

Each microbial suspension 100 μL was inoculated in a test tube containing a Durham tube and 1 mL of Giltay liquid medium ($KNO_3$ 1.0 g; asparagine 1.0 g; 1% bromothymol blue solution 5 mL; sodium citrate 8.5 g; $MgSO_4 \cdot 7H_2O$ 1.0 g; $FeCl_3 \cdot 6H_2O$ 0.05 g; $KH_2PO_4$ 1.0 g; $CaCl_2.6H_2O$ 0.2 g; and distilled water 1,000 mL; pH 7.0) and a test tube containing only the Giltay liquid medium, respectively. Each of the test tubes was cultured at 30° C. for 7 days.

With respect to the Giltay liquid medium with the Durham tube, change in the color of the culture medium from green to dark blue owing to disappearance of nitrate and formation of gas bubble in the Durham tube owing to gasification of the nitrate were investigated.

Also, with respect to the Giltay liquid medium, the presence of nitrate and nitrite in the liquid medium was investigated using a Griess-Ilosvay reagent (prepared by mixing equimolar amounts of a 1st solution containing sulfanilic acid 0.5 g; acetic acid 30 mL; and distilled water 70 mL and a 2nd solution containing α-naphthylamine 0.5 g; acetic acid 30 mL and distilled water 70 mL) and a zinc powder.

As a result, in 4 strains among 88 strains, gas bubble was produced in the Durham tube and nitrate and nitrite were absent in the liquid medium after culture. Accordingly, these four strains were determined as strains having the denitrifying ability and therefore selected.

Next, the nitrate-reducing ability of the four strains of the denitrifying bacteria was evaluated.

Each microbial strain was cultured in Tryptic Soy broth (manufactured by Difco Co., Ltd., Bacto Tryptic Soy Broth; that is, Soybean-Casein Digest Medium; hereinafter referred to as 1/10 TS broth) and then collected by centrifugation. The collected bacterial cells were washed twice with 100 mM phosphate buffer and then suspended again in phosphate buffer. Further, the concentration of the bacterial cells in the suspension was adjusted to $10^8$ to $10^9$ cfu/mL.

[Composition of the 1/10 TS broth]

| | |
|---|---|
| Final volume | adjusted to 1,000 mL by adding distilled water |
| Casein | 1.7 g |
| D-glucose | 0.25 g |
| NaCl | 0.5 g |
| $K_2HPO_4$ | 2.5 g |

Each microbial suspension 100 μL was added to 100 mM phosphate buffer containing sodium nitrate and glucose and adjusted to 500 μL in total. The resulting reaction solution contained 10 mM sodium nitrate and 10 mM glucose. The reaction solution was kept still at 30° C. for 1 hour. The solution was ice-cooled to stop the reaction and centrifuged to collect the supernatant of the reaction solution. For coloring nitrite-nitrogen in the supernatant, sulfanylamide and N-naphthylethylenediamine hydrochloride were used. The concentration of nitrite-nitrogen in the reaction solution was calculated by converting the transmittance of the filter at 550 nm to the nitrite-nitrogen content by using BIOLISE. The results are shown in FIG. 1.

Based on the results, the strain having the highest denitrifying ability was selected and named as LG77.

Example 2

Identification of the Denitrifying Microorganism

The bacteriological characteristics of the microorganism LG77 having the highest denitrifying ability that was selected in Example 1 are shown in Table 1.

TABLE 1

| Tested items | LG 77 |
|---|---|
| Shape | Rod |
| Gram stain | − |
| Spore | − |
| Motility | + |
| Behavior toward oxygen | Aerobic |
| Oxidase | + |
| Catalase | + |
| OF | O |
| Color tone of colony | NP |
| Production of fluorochrome | NT |
| Reduction of nitrate | + |
| Production of indole | − |
| Fermentation of glucose | − |
| Arginine dihydrolase | − |
| Urease | − |
| Degradation of esculin | + |
| Liquefiability of gelatin | − |
| β-galactosidase | + |
| Utilization | |
| Glucose | + |
| L-arabinose | + |
| D-mannose | + |
| D-mannitol | + |
| N-acetyl-D-glucosamine | − |
| Maltose | + |

TABLE 1-continued

| Tested items | LG 77 |
|---|---|
| Potassium gluconate | − |
| n-capric acid | − |
| Adipic acid | − |
| dl-malic acid | + |
| Sodium citrate | − |
| Phenyl acetate | − |
| Sorbitol | + |
| Growth on MacConkey agar | + |
| Production of insoluble yellow pigment | − |
| Hydrolysis of Tween 80 | − |
| Indentification result | *Agrobacterium radiobacter* |

*Identification result by Japan Food Research Laboratories
NP: Characteristic colony pigment was not produced
NT: Not tested From the results shown in Table 1, the LG77 strain was identified as microorganism belonging to *Agrobacterium radiobacter*.

The identification was carried out by Japan Food Research Laboratories.

The LG77 strain has been deposited as *Agrobacterium radiobacter* LG77 (FERM BP-8386) under International Patent Organism Depositary, as described above.

Example 3

The Effect of the Treatment During Curing Process on Suppression of TSNA Formation in Tobacco Leaves The LG77 stain was inoculated in the 1/10 TS culture medium described in Example 2 and cultured at 30° C. for 72 hours. After the culture, the culture medium containing the bacterial cells was subjected to centrifugation at 5,000 rpm to collect the bacterial cells.

The obtained bacterial cells were washed twice with sterilized distilled water and then suspended again in sterilized distilled water. The concentration of the microorganism in the suspension was adjusted to be $10^8$ to $10^{10}$ cfu/mL with distilled water.

Tobacco leaves of Burley variety (Kitakami 1) which had been harvested to be brought into the curing process were treated with the above-mentioned microbial suspension.

The treatment was carried out three times, i.e., immediately after the harvest, 3 days after the harvest, and 8 days after the harvest. In each treatment, the suspension was sprayed on the front and back surfaces of the tobacco leaves such that 10 mL thereof was sprayed per one piece of tobacco leaf. In the control group, tobacco leaves were not treated with the microbial suspension or tobacco leaves were treated with sterilized distilled water containing no bacterial cells with the same manner as the microbial treatment.

The tobacco leaves were air-cured by using a pipe house.

The non-treated and treated tobacco leaves were collected on 21st day and 32nd day in the curing process. The collected tobacco leaves were separated into the lamina and stem parts and freeze-dried Each sample of the freeze-dried lamina was ground by a mixer. For the quantitative determination of TSNA content, only the sample of the lamina part was used.

About 5 g of each ground lamina sample was put into a 200 mL Erlenmeyer flask, mixed with 100 mL of 0.01 M NaOH solution (containing Thimerosal 100 μg/mL), and subjected to extraction at a room temperature for 2 hours by using an agitator. Thereafter, the extract was filtrated with a filter paper (ADVANTEC Co., Ltd., No. 5C).

Contents of NNN, NNK, NAT, and NAB were determined by gas chromatography in accordance with an improved method of Spiegelhalder (Spiegelhalder B., Kubacki S. and Fischer S. (1989) Beitr. Tabakforsch. Int., 14(3), 135-143, Fischer S. and Spiegelhalder B., (1989) Beitr. Tabakforsch. Int., 14(3), 145-153).

At first, 10 mL of each filtrate was applied on a column filled with Kieselgur (particle diameter: 60 to 160 mm; manufactured by MERCK Co., Ltd.) and ascorbic acid. TSNA was eluted with dichloromethane. The eluted dichloromethane solution was used as a sample for gas chromatography. Each obtained sample was analyzed using Gas Chromatography HP 6890 (manufactured by Hewlett-Packard Co., Ltd.) equipped with Column DB-17 (manufactured by J & W Co., Ltd.) and Detector TEA-543 (manufactured by Thermedics Co., Ltd.).

The results are shown in Table 2.

TABLE 2

Change in TSNA content in tobacco leaves during curing process (μg/g)

| Days after harvest | Treatment | NNN | NNK | NAT | NAB | Total TSNA |
|---|---|---|---|---|---|---|
| 0 day | Group common to all | 0.22 | 0.04 | 0.26 | 0.2 | 0.54 |
| 21 days | Not-treated | 1.51 | 0.52 | 0.98 | ND | 3.01 |
| | Treated with water | 1.55 | 0.61 | 1.29 | ND | 3.45 |
| | Treated with LG77 | 0.97 | 0.45 | 0.80 | ND | 2.22 |
| 32 days | Not-treated | 1.09 | 0.29 | 0.92 | 0.03 | 2.33 |
| | Treated with water | 1.65 | 0.32 | 1.33 | 0.06 | 3.36 |
| | Treated with LG77 | 0.65 | 0.19 | 0.87 | ND | 1.71 |

The TSNA content was found highest in the leaves treated only with water among those three test groups and 3.45 and 3.36 μg/g on 21st day and 32nd day, respectively in the curing process. The TSNA content in the tobacco leaves treated with the denitrifying bacterium was lowest among the three test groups and 2.22 and 1.71 μg/g on 21st day and 32nd day, respectively in the curing process, which were lower than those in the not-treated leaves that were 3.01 and 2.33 μg/g, respectively.

From the above-mentioned results, it is shown that the LG77 strain can suppress TSNA formation in tobacco leaves.

Example 4

The Effect of the Treatment During Curing Process on Suppression of Nitrite-nitrogen Formation in Tobacco Leaves The content of the nitrite-nitrogen in tobacco leaves treated in Example 3 was quantitatively measured. The measurement method of the nitrite-nitrogen content will be described below.

At first, about 0.5 g of lamina was collected from tobacco leaves of each group and placed in a 50 mL centrifuge tube, and 25 mL of an extraction solution described below was added thereto. The mixture was then agitated at a room temperature for 30 minutes to extract nitrite-nitrogen. Each obtained extract was filtered by using a filter paper (ADVANTEC, No. 1) and 10 mL of the extract was loaded to another centrifuge tube, mixed with activated carbon 0.5 g, and agitated at a room temperature for 15 minutes. Further, the activated carbon was removed by filtration with a filter paper (ADVANTEC, No. 5). The obtained filtrate was used as a sample for determining the nitrite-nitrogen content.

Extraction solution:
KCl (1% KCl)
Sulfanylamide (0.5% sulfanylamide)
Triton X-100 (0.1% Triton X-100)

In the determination of the nitrite-nitrogen content in the extract, an autoanalyzer (manufactured by BRAN+LUEBBE Co., Ltd., AACSII) was used and the nitrite-nitrogen content was calculated by converting the transmittance of the filter at 550 nm to the nitrite-nitrogen content. For coloring nitrite-nitrogen, 1% of sulfanylamide and 0.1% of N-naphthylethylenediamine dihydrochloride were used.

The results are shown in Table 3.

TABLE 3

Change in nitrite-nitrogen in tobacco leaves during curing process (μg/g)

| Treatment | Days after harvest 0 | 21 | 32 |
|---|---|---|---|
| Not-treated | 0.71 | 4.32 | 3.30 |
| Treated with water | | 4.54 | 5.17 |
| Treated with LG77 | | 3.93 | 2.09 |

The nitrite-nitrogen content in the leaves treated only with water was found highest among those three tested groups and 4.54 and 5.17 μg/g on 21st day and 32nd day, respectively in the curing process. The nitrite-nitrogen content in the tobacco leaves treated with the denitrifying bacterium was lowest among the three tested groups and 3.93 and 2.09 μg/g on 21st day and 32nd day, respectively in the curing process, which were lower than those in the not-treated leaves.

From the results of Example 3 and Example 4, it is shown that the content of TSNA in the tobacco leaves is related to the content of nitrite in the tobacco leaves. That is, it is shown that as the content of nitrite is higher, the amount of TSNA formed is larger.

Example 5

Fixation of Denitrifying Bacteria During Curing Process

The LG81 strain used in this experiment is denitrifying bacterium A belonging to *Agrobacterium radiobacter* isolated in Example 1, and LG30 and CB301 strains are microorganisms belonging to *Pseudomonas* genus having the denitrifying ability. These strains are isolated from the surface of tobacco leaves and have the denitrifying ability.

Each strain was inoculated in the 1/10 TS culture medium with the same composition as that described in Example 2 and cultured at 30° C. for 72 hours. After the culture, the culture medium containing the bacterial cells of the strain was subjected to centrifugation at 5,000 rpm to collect the bacterial cells.

The obtained bacterial cells were washed twice with sterilized distilled water and then suspended again in sterilized distilled water. The concentration of the bacterial cells in the suspension was adjusted to be $10^8$ to $10^{10}$ cfu/mL with distilled water.

Tobacco leaves of Burley variety (Kitakami 1) were treated with the obtained microbial suspension 1 day and 7 days after the harvest in such a manner that the suspension was sprayed on the front and back surfaces of the tobacco leaves in an amount of 10 mL per one piece of tobacco leaf.

After 20 day-curing, the not-treated and the treated leaves were collected. The collected tobacco leaves were separated into the lamina and stem portions and the lamina portion was partially cut off as samples. The obtained samples were finely cut to 5 mm squares and approximately 10 g of the each cut sample was put into a 300 mL Erlenmeyer flask. After that, 200 mL of 10 mM phosphate buffer (pH 7.0) was added thereto and the mixture was homogenized. The obtained suspension was used as a tobacco suspension for the isolation of microorganisms.

The obtained tobacco suspension was diluted with the phosphate buffer to a concentration proper for the isolation of microorganisms ($10^2$ to $10^5$ times dilution). The diluted suspension was applied, by dropping 0.1 mL a time, on a YG agar plate medium with the same composition as that described in Example 1, and then cultured at 30° C. for 7 days. The grown colonies were isolated into a single colony by using a fresh YG agar plate medium. The isolated microorganism was stored at −80° C. till used for experiments.

To culture the test microorganism, the YG agar plate medium was used. The grown microorganism was suspended in sterilized distilled water in a concentration of about $10^7$ cfu/mL to obtain a microbial suspension for inoculation.

Similarly to the above-described Example 2, with respect to the Giltay liquid medium with the Durham tube, change in the color of the culture medium from green to dark blue owing to disappearance of nitrate and formation of gas bubble in the Durham tube owing to gasification of the nitrate were investigated. Also, with respect to the Giltay liquid medium, similarly to Example 1, the presence of nitrate and nitrite in the culture medium was investigated using a Griess-Ilosvay reagent and a zinc powder.

Ten strains were isolated as the microorganism having the denitrifying ability in the leaves treated with LG77 and LG81 strains and investigated on their identity. The investigation was carried out using Biolog System (manufactured by Gunze Sangyo Industry).

The results are shown in Table 4.

TABLE 4

| | Ratio of denitrifying bacteria to total number of bacteria on 20th days of curing process | | | |
|---|---|---|---|---|
| | Number of total | Number of | Ratio(%) | |
| Treatment | bacteria (log(cfu/g DW)) | isolated bacteria | Denitrifying bacteria | Other bacteria |
| Not-treated *Agrobacterium radiobacter* | 7.08 | 50 | 0.0 | 100.0 |
| LG77 | 7.04 | 59 | 28.8 | 71.2 |
| LG81 | 7.43 | 63 | 28.6 | 71.4 |
| *Pseudomonas* spp. | | | | |
| LG30 | 7.57 | 34 | 0.0 | 100.0 |
| CB301 | 7.91 | 50 | 0.0 | 100.0 |

The ratio of the microorganism having the denitrifying ability to the total number of the isolated microorganism on 20th day of curing was investigated. As a result, no microorganism having the denitrifying ability was isolated in the not-treated leaves and the leaves treated with *Pseudomonas* spp. On the other hand, nearly 30% of isolated microorganism was identified as denitrifying bacteria on 20th day of curing in the leaves treated with *Agrobacterium radiobacter*. In the leaves treated with *Agrobacterium radiobacter,* 10 strains were isolated as the microorganism having the denitrifying ability and investigated on their identity. As a result, it was found that all of the strains belonged to *Agrobacterium radiobacter*. Accordingly, it is shown that *Agrobacterium radiobacter* has high fixation property in tobacco leaves during curing process of the tobacco leaves.

According to the invention, as described above, there is provided a method of reducing the content of TSNA, which is formed in curing and storage processes, that is applicable to the current curing and storage processes.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of reducing the content of nitrite and/or nitrosamine in tobacco leaves, comprising treating the tobacco leaves with an isolated *Agrobacterium radiobacter* LG77 (FERM BP-8386) having a denitrifying ability, by any one of the following (i) to (iii), after the tobacco leaves are harvested:

(i) spraying a suspension of the microorganism on a surface of the tobacco leaves, (ii) coating the surface of tobacco leaves with a powder containing the microorganism, and (iii) immersing the tobacco leaves in a liquid containing the microorganism.

2. A method of reducing the content of nitrite and/or nitrosamine in tobacco leaves, comprising treating the tobacco leaves with an isolated *Agrobacterium radiobacter* LG77 (FERM BP-8386) having a denitrifying ability, by any one of the following (i) to (iii), after the tobacco leaves are harvested and before nitrite accumulates in the tobacco leaves:

(i) spraying a suspension of the microorganism on a surface of the tobacco leaves, (ii) coating the surface of tobacco leaves with a powder containing the microorganism, and (iii) immersing the tobacco leaves in a liquid containing the microorganism.

* * * * *